United States Patent [19]

Easton

[11] 4,140,082

[45] Feb. 20, 1979

[54] ANIMAL HOLDER

[76] Inventor: Harlan J. Easton, R.R. 3, Blooming Prairie, Minn. 55917

[21] Appl. No.: 854,885

[22] Filed: Nov. 25, 1977

[51] Int. Cl.[2] ..... A61D 3/00

[52] U.S. Cl. ..... 119/103

[58] Field of Search ..... 119/103, 98; 269/328, 269/130, 131, 132, 133, 134; 5/92, 317, 336; 128/133, 134; 224/42.4

[56] References Cited

U.S. PATENT DOCUMENTS

| | | | |
|---|---|---|---|
| 1,705,115 | 3/1929 | Hollestelle | 119/103 |
| 1,746,115 | 2/1930 | Hermanni | 119/103 |
| 2,114,995 | 4/1938 | Coe | 119/103 |
| 2,708,422 | 5/1955 | Morrison | 119/103 |
| 2,965,071 | 12/1960 | Scott et al. | 119/103 |
| 3,389,691 | 6/1968 | Poage | 119/103 |

*Primary Examiner*—Hugh R. Chamblee

*Attorney, Agent, or Firm*—Merchant, Gould, Smith, Edell, Welter & Schmidt

[57] ABSTRACT

A holder for supporting animals such as pigs, sheep and the like, during castration or other treatment performed on the animals. An elongated tray has a U-shaped member including legs depending from the tray, the legs having adjustable hooks for engagement with the top of a fence or other partition to support the tray. A pair of straps are adapted to partially encircle the portion of an animal between its front and rear legs, and are provided at one end with a hook for releasable engagement with one side of the tray. The opposite ends of the straps are secured to an adjustment member whereby an animal is snugly secured in the tray. A neck-engaging strap is secured to the tray adjacent one end of the tray.

12 Claims, 5 Drawing Figures

ANIMAL HOLDER

BACKGROUND OF THE INVENTION

This invention relates generally to the field of animal husbandry, and more particularly to the treatment of young livestock, such as castrating and administering medication thereto.

The holding of young animals, such as sheep or pigs, for castration, spading and administering of medication thereto, is difficult, due to the tendency of the animals to struggle against being held in a stationary condition. The holder of this invention is adapted to support and securely hold a young animal against undue movement and in a position to be quickly and easily operated upon, and to conveniently have medication, such as disease preventive medicines and the like, applied by hypodermic means.

SUMMARY OF THE INVENTION

The animal holder of this invention comprises an elongated open ended tray having a bottom portion and opposed side portions, together with a pair of laterally spaced legs extending downwardly from the tray and a pair of downwardly opening supporting hook elements. The holder further involves means mounting each of said hood elements on a different one of the legs, elongated animal confining strap means, anchoring means at one end of said strap means including a hook, and a hook engaging flange projecting downwardly from the tray adjacent one side thereof and intermediate the ends of the tray. A slide bar extends downwardly from said tray adjacent the other side thereof and intermediate said legs. A slide member is slidably mounted on said slide bar and includes means for connection to the end of said confining strap means. A locking element on said slide member engages said slide bar to releasably lock said slide member against movement in one direction longitudinally of said slide bar.

DETAILED DESCRIPTION OF THE PREFERRED EMBODIMENT

Figure 1:
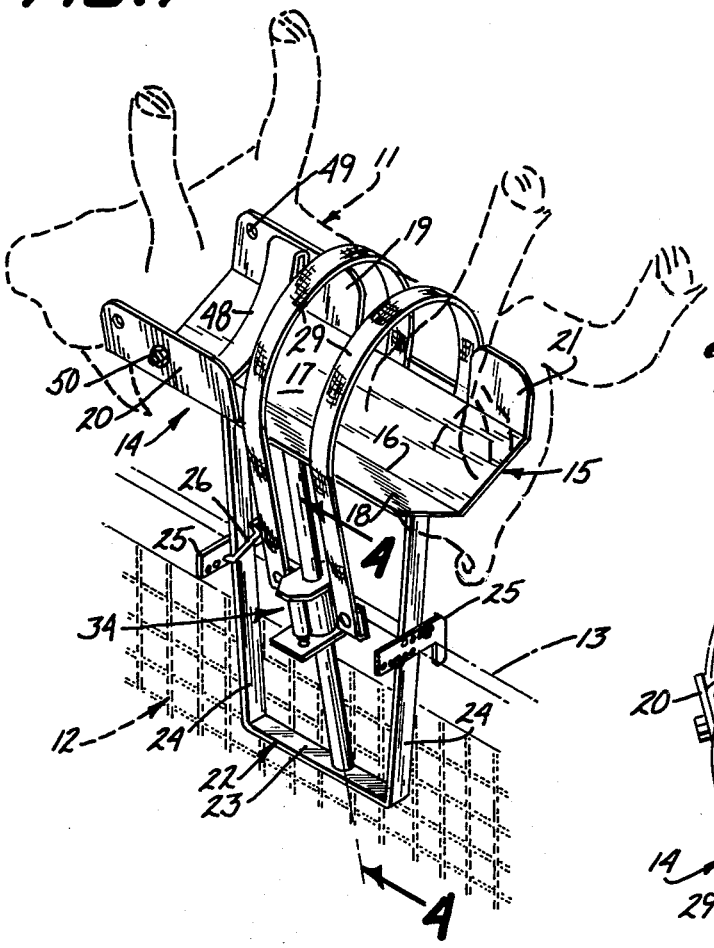
FIG. 1 is a view in perspective of the animal holder of this invention, showing the same as being mounted on a fence rail and having a young animal held thereon.
Figure 2:
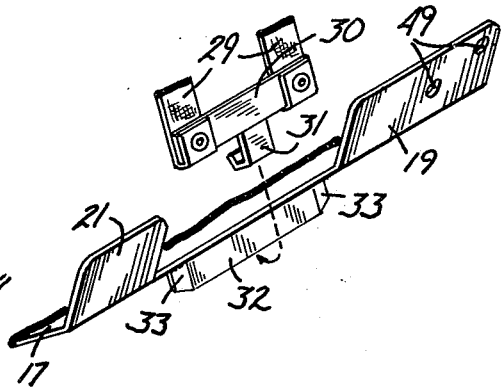
FIG. 2 is a fragmentary view in perspective of the opposite side of the animal holder as that shown in FIG. 1.

In FIG. 1, a small animal, such as a pig, is shown by dotted lines, and indicated generally at 11, the same being supported on the animal holder of this invention, the holder being mounted on a fence or partition shown by broken lines in FIG. 1 and indicated at 12. The fence or partition 12 includes a top rail 13. The animal holder includes an elongated tray 14 having a bottom portion 15 that is bent on a longitudinal center fold line 16 to provide upwardly diverging bottom sections 17 and 18. The tray 14 further includes side portions in the nature of a pair of upwardly projecting wall members 19 and 20 at one end portion of the tray 14, and a third upwardly projecting wall member 21 longitudinally spaced from and coplanar with the wall member 19. As shown, the wall members 19 and 21 project generally upwardly from the outer side edge of the bottom section 17, the wall member 20 projecting generally upwardly from the outer edge of the bottom section 18.

Means for supporting the tray 14 on the fence or partition 12 comprises a generally U-shaped member 22 formed to provide a generally horizontal base portion 23 and a pair of legs 24 that extend upwardly from the base 22 and are welded or otherwise rigidly secured at their upper ends to the bottom portion 15 of the tray 14. Preferably, and as shown, the upper ends of the legs 24 are secured to the bottom surface of the bottom tray section 17. A pair of downwardly opening supporting hook elements 25 are slidably mounted one each on a different one of the legs 24, and are releasably clamped to their respective legs 24 by clamping members in the nature of nut equipped U bolts 26. The opposite end portions of the U bolts 26 extend through selected pairs of laterally spaced openings 27 in the hook elements 25, whereby the hook elements 25 may be clamped in desired relationship transversely of their respective legs 24, to accommodate rails 13 or the upper ends of partitions of various thicknesses. It will be noted that the U bolts 26 permit the hook elements 25 to be adjusted longitudinally with respect to the legs 24, so that the tray 14 may be supported at any elevation convenient to the user.

Means for confining the animal 11 in the tray 14 comprises a pair of elongated flexible straps 29 that are riveted or otherwise rigidly secured at one end to an opposite end of a spacer bar 30 to the intermediate portion of which is welded or otherwise rigidly secured a generally upwardly opening hook 31. The hook 31 is adapted to engage a flange 32 that projects downwardly from the outer side edge of the bottom section 17 intermediate the side wall members 19 and 21. The flange 32 has inturned opposite ends 33 that limit movement of the hook 31 in directions longitudinally of the tray 14.

The ends of the straps 29 opposite the spacer bar 30 are rigidly connected to a slide member that comprises a main body portion 35, a top plate 36, a hook-like element 37, and a pair of anchoring flanges 38 extending outwardly from opposite sides of the body 35 and in a direction longitudinally of the tray 14. The adjacent ends of the straps 29 are rigidly secured to the anchoring flanges 38 by rivets or the like 39.

The body portion 35 and top plate 36 are provided with an opening 40 therethrough for loosely slidably receiving a slide rod or bar 41 that is welded or otherwise rigidly secured at its upper end to the tray bottom section 18 adjacent its outer side edge, and at its lower end to the base 23 of the U-shaped member 22.

Means for releasably locking the slide member 34 against movement longitudinally of the slide bar 41 comprises a locking plate 42 having a notch 43 in one end thereof that is loosely received in a recess 44 in the hook-like element 37. The locking plate 42 has an opening 45 therethrough which normally slidably receives the slide rod 41 when the locking plate 42 is disposed at right angles to the longitudinal dimension of the slide rod 41. The main body portion 35 of the slide member 34 has a downwardly opening recess 46 therein which contains a coil compression spring 47 the lower end of which engages the locking plate 42 and yieldingly urges the locking plate 42 in a downward direction with respect to the main body portion 35. Movement of the notched end of the locking plate 42 is limited by the hook-like element 37 to a generally pivotal movement, so that the spring 47 causes the locking plate 42 to tilt with respect to the slide bar 41 and exert a binding engagement thereon, so as to lock the slide member 34 against upward movement on the slide bar 41.

Preparatory to holding an animal, such as the pig 11, in the tray 14, the slide member 34 is raised by lifting the locking plate 42 against bias of the spring 27, which operation releases the binding engagement of the locking plate with the slide rod 41. With the slide member 34 raised to an elevation close to the tray 14, the hook 31 is disengaged from the flange 32, and the straps 29 removed from above the tray 14. After placing the animal 11 in the tray, the hook 31 is then moved into engagement with the flange 32 and the slide member 34 pushed downwardly on the slide bar 41 until the straps 29 securely hold the animal in the tray 14. After the required operation is performed on the animal, the slide member 34 is again raised to a point where the hook 31 can be easily disengaged from the flange 32 and moved to the same side of the tray as the slide member 34. The animal can then be lifted out of the tray and released.

Figure 3:
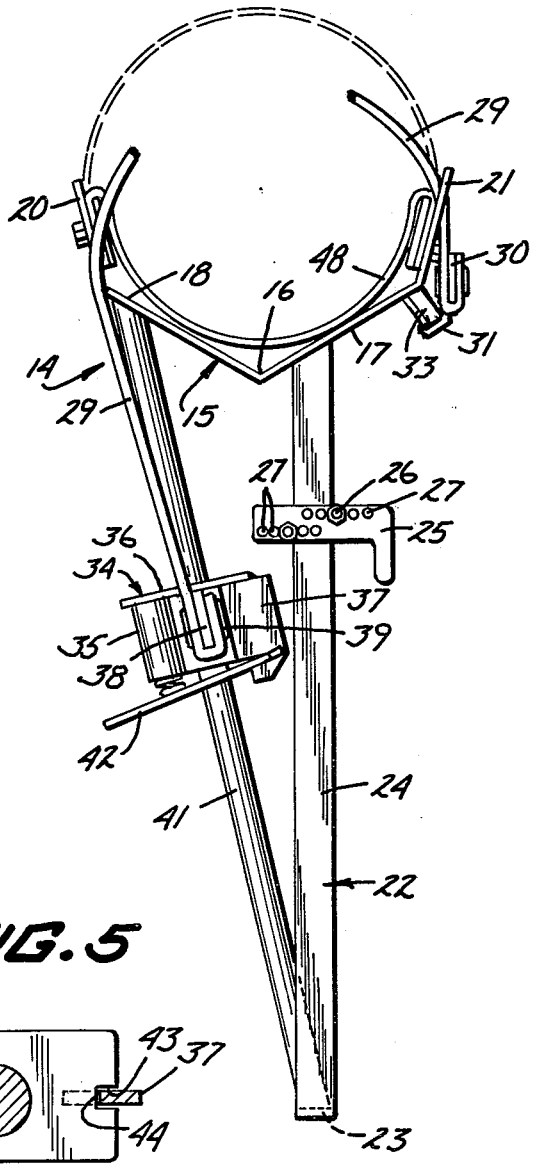
FIG. 3 is an enlarged view in end elevation.
Figure 4:
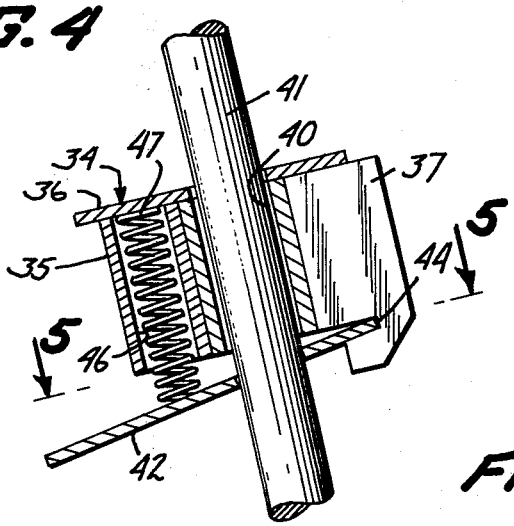
FIG. 4 is an enlarged fragmentary section taken generally on the line 4—4 of FIG. 1.
Figure 5:
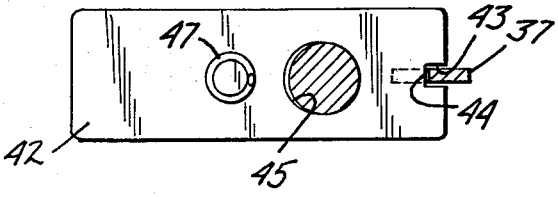
FIG. 5 is a fragmentary section taken on the line 5—5 of FIG. 4.

For the purpose of more securely holding smaller animals, a neck-receiving strap 48 is disposed between the pair of wall members 19 and 20. The wall members 19 and 20 are provided with pairs of opposed openings 49 therein for selective reception of nut equipped bolts or screws 50 that are used to anchor the opposite ends of the neck-receiving strap 48 to the wall members 19 and 20. When confining smaller animals, the strap 48 is disposed in its dotted line position of FIG. 3, and the head and neck of the animal is inserted therebetween and the tray. When the tray 14 is used to hold animals that are too large for the head to be inserted through the opening defined by the strap 48 and the tray 14, the strap 48 is disposed in its full line position of FIG. 3 so that the neck of the animal rests thereon. Even in this latter position of the strap 48, the same does effect sufficient friction on the animal's neck to aid in holding the animal against movement longitudinally of the tray when the animal is confined by the straps 29.

While I have shown and described a commercial embodiment of my animal holder, it will be understood that the same is capable of modification without departure from the spirit and scope of the invention, as defined in the claims.

What is claimed is:

1. An animal holder comprising:

(a) an elongated open ended tray having a bottom portion and opposite side portions;

(b) a pair of laterally spaced legs extending downwardly from said tray;

(c) a pair of downwardly opening supporting hook elements;

(d) means mounting each of said hook elements on a different one of said legs;

(e) elongated animal confining strap means;

(f) anchoring means at one end of said strap means including a hook;

(g) a hook engaging flange projecting downwardly from said tray adjacent one side thereof and intermediate the ends of said tray;

(h) a slide bar extending downwardly from said tray adjacent the other side thereof and intermediate said legs;

(i) a slide member slidably mounted on said slide bar and including means for connection to the other end of said confining strap means;

(j) and a locking element on said slide member and engaging said slide bar to releasably lock said slide member against movement in one direction longitudinally of said slide bar.

2. The animal holder defined in claim 1 in which said tray bottom portion is bent substantially on a longitudinal center line to provide a pair of upwardly diverging bottom sections.

3. The animal holder defined in claim 2 in which said side portions include a pair of wall members each projecting upwardly from an outer edge of a different bottom section adjacent one end of said tray, and a third wall member projecting upwardly from the outer edge of one of said bottom sections adjacent the other end of said tray coplanar with and in longitudinally spaced relation to one of the wall members of said pair thereof.

4. The animal holder defined in claim 3 in which said hook engaging flange is disposed below the space between said coplanar wall members.

5. The animal holder defined in claim 3, further including an animal neck-engaging strap extending between said pair of wall members, said pair of wall members having pairs of spaced openings therethrough, and mounting screws at opposite ends of said neck-engaging strap and receivable in selected respective openings in said pair of wall members.

6. The animal holder defined in claim 1 in which said strap means comprises a pair of laterally spaced straps, said anchoring means including a spacer bar having one end of each of said straps connected to an opposite end of the spacer bar, said hook being disposed at the central portion of said spacer bar.

7. The animal holder defined in claim 6 in which said flange is formed to provide a pair of inturned end portions each engageable with said hook to limit movement of said hook in directions longitudinally of said tray.

8. The animal holder defined in claim 6 in which said means connected to the other end of said strap means includes a pair of anchoring flanges projecting outwardly in opposite directions from said slide member and each connected to a respective other end of a different one of said straps.

9. The animal holder defined in claim 1 in which said legs comprise opposite sides of a generally U-shaped member having a base portion connecting the lower ends of said legs, said slide bar having a lower end anchored to said base.

10. The animal holder defined in claim 1 in which said hook element mounting means comprises a pair of clamps one for each of said hook elements and each straddling a different one of said legs, said hook elements each having a plurality of openings for selective reception of portions of said clamps, said openings being spaced apart in directions transversely of said legs, whereby said hook elements are adjustable both longitudinally and transversely of said legs.

11. The animal holder defined in claim 1 further including an animal neck-receiving strap having opposite ends each connected to an opposite side portion of said cradle adjacent one end of said tray.

12. The animal holder defined in claim 1 in which said locking element comprises a locking bar mounted for pivotal movements on said slide member and having an opening therethrough loosely receiving said slide bar, and in further combination with a spring yieldingly urging said locking bar in a direction of pivotal movement thereof to impart binding engagement of said locking bar with said slide bar.

* * * * *